United States Patent [19]

Gebhardt et al.

[11] 4,330,102

[45] May 18, 1982

[54] MERCHANDISING DISPLAY

[75] Inventors: James L. Gebhardt, Roswell; Ferris L. Hutchins, Jr., Doraville, both of Ga.

[73] Assignee: The Mead Corporation, Dayton, Ohio

[21] Appl. No.: 198,658

[22] Filed: Oct. 20, 1980

Related U.S. Application Data

[63] Continuation of Ser. No. 48,901, Jun. 15, 1979, abandoned.

[51] Int. Cl.[3] ..... A47B 97/04

[52] U.S. Cl. ..... 248/459

[58] Field of Search ..... 40/124.1, 154, 155, 40/152.1, 312, 539; 229/33, 36, 38, 34 HW, DIG. 11; 248/174, 459, 460

[56] References Cited

U.S. PATENT DOCUMENTS

| | | | |
|---|---|---|---|
| 1,892,194 | 12/1932 | Taylor | 40/539 |
| 2,511,211 | 6/1950 | Klein et al. | 40/124.1 X |
| 2,893,622 | 7/1959 | Fogel | 229/34 HW |
| 3,273,272 | 9/1966 | Paige | 40/124.1 |
| 3,424,366 | 1/1969 | Williamson | 229/34 HW X |
| 3,455,949 | 5/1969 | Rohde | 40/124.1 |
| 3,531,170 | 9/1970 | Boyer | 229/36 X |
| 3,981,431 | 9/1976 | Matsuyama | 229/34 HW |

*Primary Examiner*—William H. Schultz

*Attorney, Agent, or Firm*—Rodgers & Rodgers

[57] ABSTRACT

A merchandising display comprises a base panel, a rear panel secured to the rear edge of the base panel, a pair of horizontal supports foldably joined respectively to the side edges of the base panel, a pair of upright supports foldably joined respectively to the side edges of the rear panel, a front support foldably joined to the front edge of the base panel, a first reinforcing rib interconnecting the horizontal supports, and a second reinforcing rib interconnecting the upright supports.

11 Claims, 6 Drawing Figures

MERCHANDISING DISPLAY

This application is a continuation of application Ser. No. 48,901, filed June 15, 1979, now abandoned.

TECHNICAL FIELD

This invention relates to temporary merchandising displays which are economical to produce and is well adapted for use in connection with heavy products such as soft drinks packaged in multiple cell carriers.

BACKGROUND ART

Merchandising displays which are normally used in connection with temporary retail promotions especially in grocery stores are well known in the arts as exemplified in the displays disclosed and claimed in U.S. Pat. No. 4,182,244 and U.S. Pat. No. 4,231,299 both of which are owned by the assignee of this invention.

DISCLOSURE OF INVENTION

According to this invention a merchandising display comprises a base panel, a rear panel secured to the base panel and extending upwardly therefrom, a pair of horizontal supports secured respectively to the sides of the base panel, a pair of upright supports secured respectively to the sides of the rear panel, and the lower edges of the upright supports being disposed in the same plane as the lower surfaces of the horizontal supports.

BEST MODE FOR CARRYING OUT THE INVENTION

Figure 1:
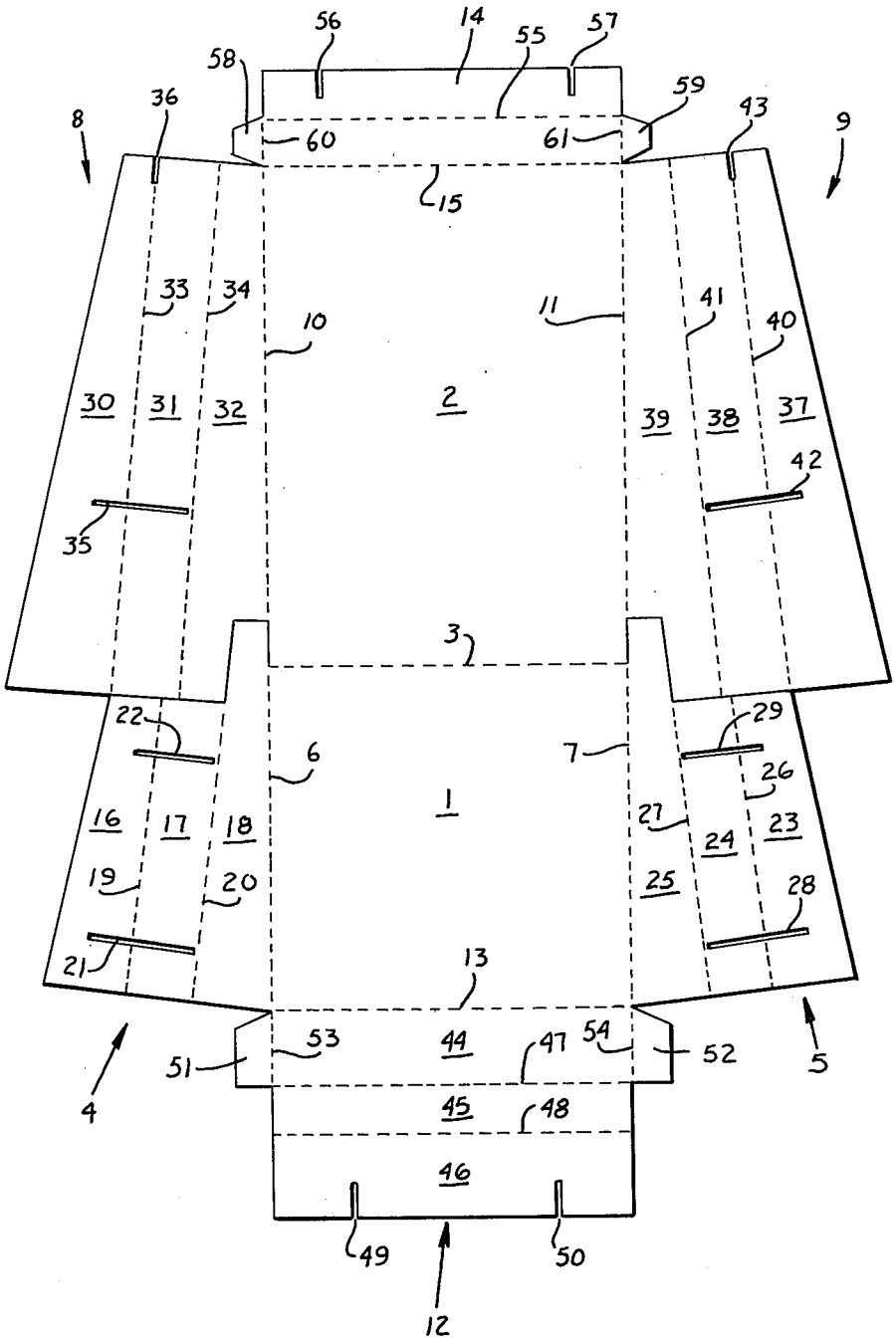
FIG. 1 is a plan view of a blank from which a merchandising display is formed according to this invention.

In the drawings the numeral 1 designates the base panel of the display to the rear edge of which rear panel 2 is foldably joined along fold line 3. Horizontal supports indicated generally by the numerals 4 and 5 are foldably joined respectively to the side edges of base panel 1 along fold lines 6 and 7. Similarly upright supports indicated generally by the numerals 8 and 9 are foldably joined respectively to the side edges of rear panel 2 along fold lines 10 and 11. In addition a front support indicated generally by the numeral 12 is foldably joined to the front edge of base panel 1 along fold line 13 and top panel 14 is foldably joined to the upper edge of rear panel 2 along fold line 15.

More specifically horizontal support 4 is provided with supporting panels 16, 17, and 18 which are interconnected by fold lines 19 and 20. In addition formed in supporting panels 16 and 17 are slots 21 and 22. Horizontal support 5 is similar to that just described and includes supporting panels 23, 24, and 25 which are interconnected by means of fold lines 26 and 27. Slots 28 and 29 are formed in supporting panels 23 and 24.

Upright support 8 is provided with supporting panels 30, 31, and 32 which are interconnected by means of fold lines 33 and 34 and, additionally, slot 35 is formed in supporting panels 30 and 31 and slot 36 is formed between the upper portions of supporting panels 30 and 31. In like manner, upright support 9 is provided with supporting panels 37, 38 and 39 which are interconnected by means of fold lines 40 and 41. Also slot 42 is formed in supporting panels 37 and 38 and slot 43 is formed intermediate the upper portions of supporting panels 37 and 38.

In order to provide additional strength for the front of the display, front support 12 is provided and includes supporting panels 44, 45, and 46 which are interconnected by means of fold lines 47 and 48. Slots 49 and 50 are formed along the upper edge of supporting panel 46. Additionally tabs 51 and 52 are foldably joined respectively to the end edges of supporting panel 44 along fold lines 53 and 54.

For the purpose of providing strength to the upper portion of the display, top panel 14 is provided and includes fold line 55 as well as slots 56 and 57. Also tabs 58 and 59 are foldably joined respectively to the end edges of top panel 14 along fold lines 60 and 61.

In actual practice the display blank is sometimes too large to be conveniently manufactured. In these instances, the blank is simply produced in two pieces with the severence point being along fold line 3. In order to complete the blank, the two pieces are simply joined along the severence line by means of adhesive tape or the like.

In order to form the display from the blank shown in FIG. 1, initially it is necessary to fold horizontal supports 4 and 5 as well as upright supports 9 and 10 into position. More specifically supporting panels 16, 17, and 18 of horizontal support 4 and supporting panels 23, 24 and 25 of horizontal support 5 are folded upwardly with respect to base panel 1 along their respective fold lines into tubular configurations whereby panels 16, 18, 23 and 25 are disposed parallel to each other and panels 1, 17, and 24 are likewise disposed parallel to each other.

Upright supports 8 and 9 are then formed in a similar fashion whereby supporting panels 30, 31 and 32 as well as supporting panels 37, 38 and 39 are folded generally upwardly with respect to rear panel 2 along their respective fold lines. By this operation panels 30, 32, 37 and 39 are folded into positions parallel to each other and panels 2, 31 and 38 are likewise folded into positions of parallel orientation so as to form tubular configurations.

Figure 2:
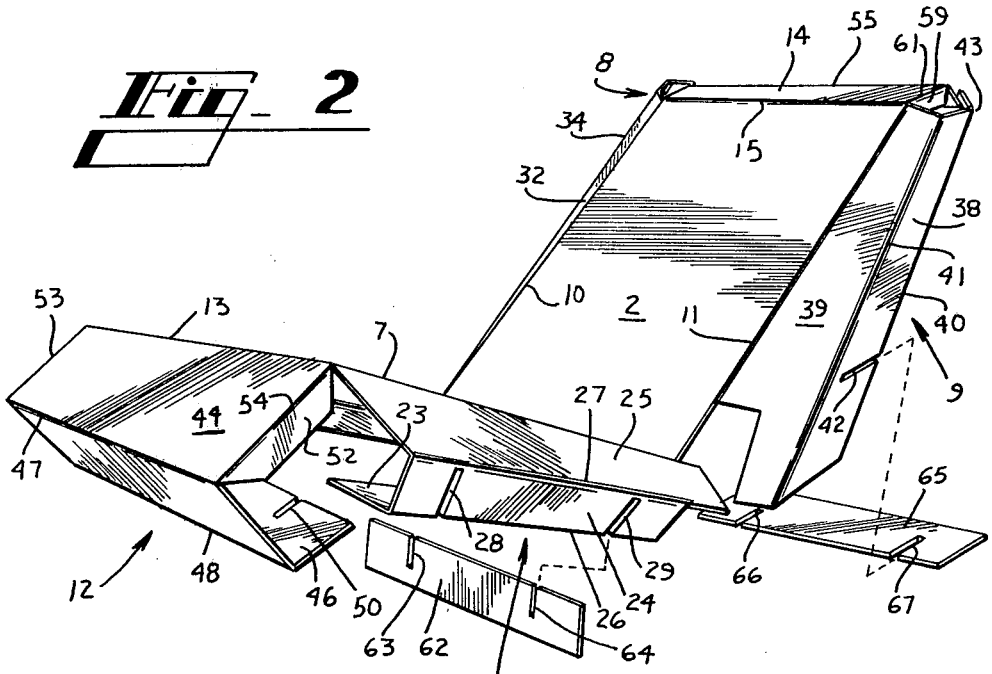
FIG. 2 is a perspective view showing formation of the display.

In order to provide additional strengthening means and with particular reference to FIG. 2, reinforcing rib 62 is then inserted into position whereby slots 63 and 64 are moved respectively into slots 22 and 29. In this manner the upper surface of reinforcing rib 62 assumes an abutting relationship with the underside of base panel 1. Similarly reinforcing rib 65 is provided as a means to interlock upright supports 8 and 9. Specifically slots 66 and 67 of reinforcing rib 65 are inserted into slots 35 and 42 respectively whereby the inner edge of reinforcing rib 65 assumes an abutting relationship with the rear surface of rear panel 2. Also each end edge of reinforcing ribs 62 and 65 forms an abutting relationship with the adjacent supporting panel and thereby provides additional display stability.

To secure the front portion of the display to horizontal supports 4 and 5, front support 12 is rotated generally upwardly of base panel 1 into a tubular configuration and slots 49 and 50 are inserted respectively into slots 21 and 28. Simultaneously with this operation, tabs 51 and 52 are tucked into positions of flat face contacting relation with the inside surfaces of supporting panels 18 and 25 respectively. After completion of the folding operations, panels 44 and 46 are disposed parallel to each other as are panels 1 and 45. In addition the upper surface of supporting panel 46 is disposed in abutting relationship with the underside of base panel 1.

Figure 3:
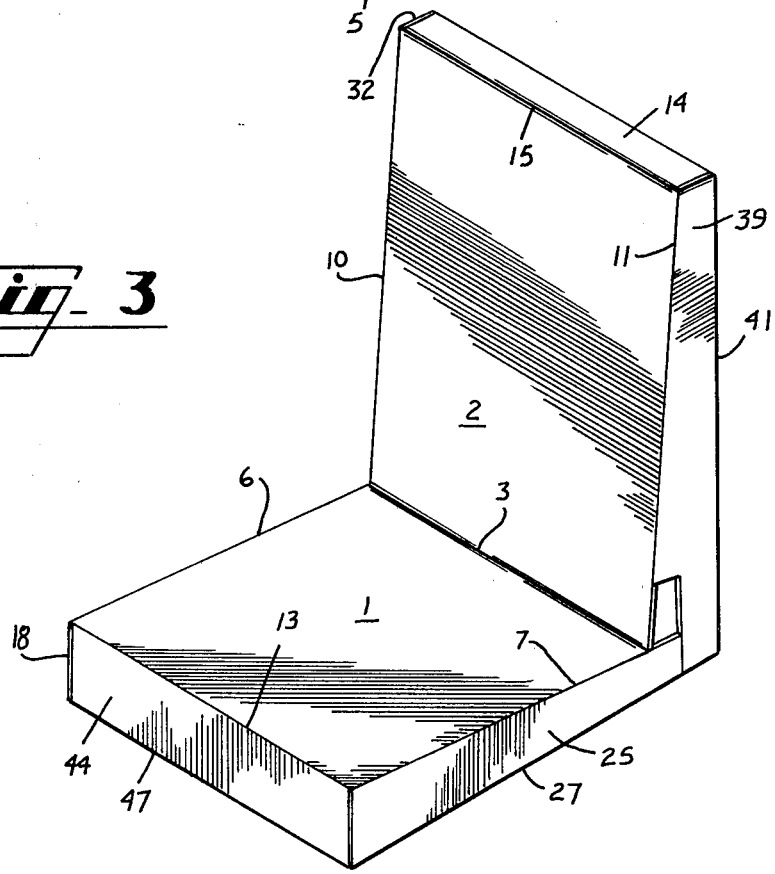
FIG. 3 is a perspective view of a set-up display.
Figure 4:
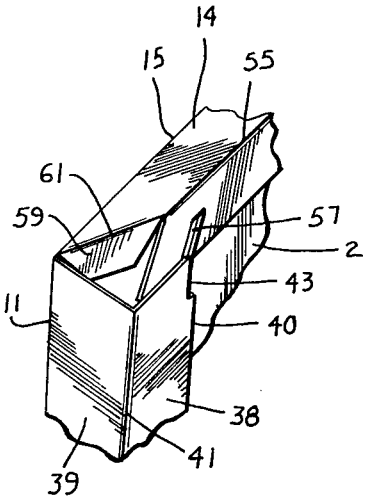
FIG. 4 is a fragmentary view of the partially formed upper portion of the display.
Figure 5:
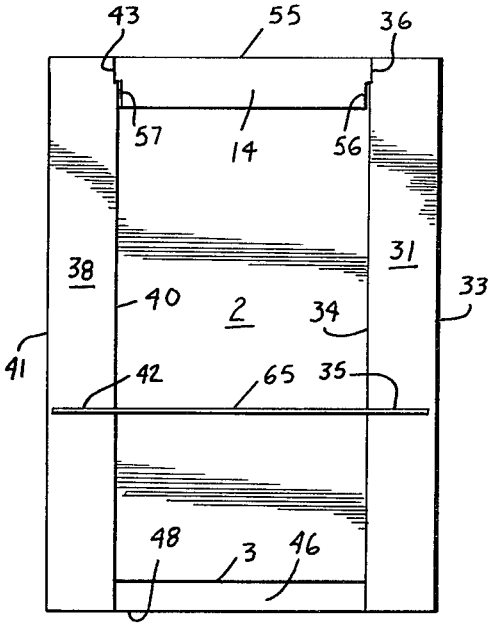
FIG. 5 is a plan view of a set up display taken from the rear.
Figure 6:
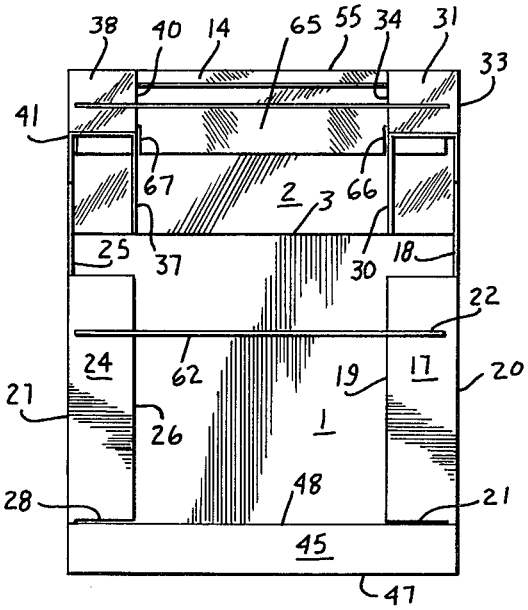
FIG. 6 is a plan view of a set up display taken from the bottom.

For the purpose of further strengthening the display, top panel 14 is folded generally upwardly along fold line 15 and tabs 58 and 59 are folded generally inwardly along fold lines 60 and 61 respectively. Then slots 56 and 57 are inserted into locking engagement respectively with slots 36 and 43. After completion of these operations, tabs 60 and 61 are disposed respectively in face contacting relation with the inner surfaces of supporting panels 32 and 39 and the outer corner portions of top panel 14 are disposed respectively in face contacting relation with the inner surfaces of supporting panels 31 and 38. In order to complete the formation of the display, the partially formed blank is inverted and the rear panel 2 together with the structure associated therewith is elevated along fold line 3 into an upright position. The display then appears as shown in FIG. 3.

After the display is fully set up, it can be easily adapted to various merchandising requirements especially in connection with retail grocery store operations. For example the display can be placed in any temporary location in the store and mounted on a support surface such as the floor of the store and then loaded with a product to be displayed such as cartons containing multiple soft drinks. Since the display is in effect interlocked at the critical points of stress, twisting and tearing of the display is prevented. In addition reinforcing ribs 62 and 65 act to prevent sagging of base panel 1 and rear panel 2 respectively and the weight of the product on base panel 1 causes a tension force across fold line 3 which in turn aids in preventing rear panel 2 from folding backwards. Also since the lower edges of upright supports 8 and 9 are disposed in the same plane as the lower surfaces of horizontal supports 4 and 5, the display is further maintained in a set up condition since rear panel 2 is in effect prevented from rotating away from base panel 1 and out of its proper position.

INDUSTRIAL APPLICABILITY

By this invention a merchandising display is provided which is economical to produce and well adapted for use in connection with temporary merchandising promotions and at the same time is extremely strong and reliable.

I claim:

1. A merchandising display arranged for mounting on a support surface and comprising a base panel, a rear panel foldably secured directly to an edge of said base panel and extending generally upwardly therefrom, and characterized in that a pair of horizontal supports are secured respectively to the sides of said base panel and are disposed underneath said base panel and a pair of upright supports are secured respectively to the sides of said rear panel and are disposed behind said rear panel, said horizontal supports and said upright supports being movable independently of each other and each of said horizontal and upright supports comprising a pair of spaced substantially parallel supporting panels and the lower edges of said upright supports being disposed in the same plane as the lower surfaces of said horizontal supports for preventing swinging movement of said rear panel about said edge of said base panel in a direction away from said base panel due to engagement with said support surface, and means interlocking said horizontal and said vertical supports.

2. A merchandising display according to claim 1 and further characterized in that a first reinforcing rib is interlocked between one of said supporting panels of each pair associated with said horizontal supports and is disposed in abutting relationship with the underside of said base panel.

3. A merchandising display according to claim 2 and further characterized in that the end edges of said first reinforcing rib are disposed respectively in abutting relationship with said horizontal supports.

4. A merchandising display according to claim 1 and further characterized in that a second reinforcing rib is interlocked between one of said supporting panels of each pair associated with said upright supports and is disposed in abutting relationship with the backside of said rear panel.

5. A merchandising display according to claim 4 and further characterized in that the end edges of said second reinforcing rib are disposed respectively in abutting relationship with said upright supports.

6. A merchandising display according to claim 1 and further characterized in that a front support is secured to the front edge of said base panel and is interlocked with the front portions of said horizontal supports.

7. A merchandising display according to claim 1 and further characterized in that the lower portions of said upright supports are disposed rearwardly of said horizontal supports.

8. A merchandising display according to claim 1 and further characterized in that a top panel is foldably joined to the upper edge of said rear panel and interlocked with the upper portions of said upright supports.

9. A merchandising display arranged for mounting on a support surface and formed from one or more blanks of foldable material comprising a base portion and a rear portion secured directly to an edge of said base portion and extending generally upwardly therefrom, said base portion including a base panel, a series of horizontal support panels joined to the side edges of said base panel and folded downwardly and inwardly to form tubular horizontal supports underneath said base panel, said rear portion including a rear panel, a series of vertical support panels joined to the side edges of said rear panel and folded independently of said horizontal support panels rearwardly and inwardly to form tubular upright supports the lower edges of which are disposed in the same plane as the lower edges of said horizontal supports for preventing swinging movement of said rear panel about said edge of said base panel in a direction away from said base panel due to engagement with said support surface, and reinforcing ribs extending between and interlocked with said horizontal and upright supports.

10. The merchandising display according to claim 9, additionally including a series of support panels joined to the front edge of said base panel and folded downwardly and inwardly into a tubular configuration and into interlocking relationship with said horizontal supports.

11. The merchandising display according to claim 10, additionally including a series of panels joined to the top edge of said rear panel and folded rearwardly and downwardly into interlocked relationship with said upright supports.

* * * * *